US007028415B2

(12) United States Patent
Heinzen et al.

(10) Patent No.: US 7,028,415 B2
(45) Date of Patent: Apr. 18, 2006

(54) CANTED MANUALLY LOADED PRODUCE DRYER

(76) Inventors: Alan Heinzen, 2482 Howell La., Gilroy, CA (US) 95020; Erick A. Davidson, 9150 Holly Hill Dr., Salinas, CA (US) 93907

( * ) Notice: Subject to any disclaimer, the term of this patent is extended or adjusted under 35 U.S.C. 154(b) by 0 days.

(21) Appl. No.: 10/819,049

(22) Filed: Apr. 5, 2004

(65) Prior Publication Data

US 2004/0211081 A1 Oct. 28, 2004

Related U.S. Application Data

(63) Continuation of application No. 10/427,588, filed on Apr. 30, 2003.

(60) Provisional application No. 60/460,220, filed on Apr. 4, 2003, provisional application No. 60/377,265, filed on Apr. 30, 2002.

(51) Int. Cl.
*F26B 5/08* (2006.01)

(52) U.S. Cl. ..... 34/312; 34/58

(58) Field of Classification Search ..... 34/58, 34/166, 174, 236, 312
See application file for complete search history.

(56) References Cited

U.S. PATENT DOCUMENTS

| | | | | |
|---|---|---|---|---|
| 2,784,500 | A * | 3/1957 | Beaumont | 34/58 |
| 3,152,078 | A | 10/1964 | Lavanchy | |
| 3,275,142 | A | 9/1966 | Ekegren et al. | |
| 3,583,076 | A | 6/1971 | Marshall | |
| 5,027,530 | A | 7/1991 | Vollmer et al. | |
| 5,307,567 | A | 5/1994 | Schnake et al. | |
| 5,460,717 | A | 10/1995 | Grimwood et al. | |
| 5,477,623 | A * | 12/1995 | Tomizawa et al. | 34/58 |
| 5,581,904 | A | 12/1996 | Ewen | |
| 5,675,905 | A * | 10/1997 | Hougham | 34/58 |
| 6,212,792 | B1 * | 4/2001 | Bier | 34/315 |
| 6,279,493 | B1 | 8/2001 | Beaumont et al. | |
| 6,298,575 | B1 | 10/2001 | Aikins et al. | |

* cited by examiner

*Primary Examiner*—S. Gravini
(74) *Attorney, Agent, or Firm*—GSS Law Group

(57) ABSTRACT

A drying apparatus for use with many kinds of objects, but is particularly suited for use in drying most kinds of produce and vegetables including leaf vegetables. In one embodiment, the dryer includes a canted drum design which provides a number of benefits and advantages over prior art designs. The canted design allows the use of a spin drying method that breaks up clumps of material in the dryer and assists in the even distribution of material, thereby improving load balance. The canted design provides ergonomic advantages to the operator when loading and unloading the dryer, and, the canted design allows easy access to the drive system for maintenance and repairs.

16 Claims, 6 Drawing Sheets

CANTED MANUALLY LOADED PRODUCE DRYER

CROSS-REFERENCE TO RELATED APPLICATIONS

The present application claims the benefit of the priority date of provisional patent application Ser. No. 60/460,220 filed Apr. 4, 2003, entitled: Canted Manually Loaded Produce Dryer; the present application is also a continuation in part of patent application Ser. No. 10/427,588, filed Apr. 30, 2003 entitled: Centrifugal Dryer and Method, which claims the benefit of the priority of provisional patent application Ser. No. 60/377,265 filed Apr. 30, 2002, entitled: Centrifugal Dryer and Method. The specification and drawings of the above-identified patent applications are hereby incorporated by reference in their entirety.

TECHNICAL FIELD

The present invention pertains to centrifugal dryers including a rotatably mounted drum. More specifically, the apparatus is a manually loaded centrifugal dryer for use in removing surface liquids from vegetables or other solid-form objects.

BACKGROUND OF THE INVENTION

In the field of vegetable processing, centrifugal dryers have been used after the cleaning process to remove surface liquids prior to packaging. Examples of such useful inventions include perforated drums that rotate the vegetables around the longitudinal axis of the drum. Generally, the washed vegetables are loaded into a basket or other container, which is then placed by hand in a drum in the dryer. The drum is spun in order to remove surface liquids.

Previously existing dryers have a number of disadvantages. Most prior dryers require the basket containing produce to be loaded and unloaded vertically. The basket and contents can weigh between 40–70 pounds. In such existing vertical dryers the operator must work the barrel free with arms extended straight with the center of mass away from the body and curl their arms up to lift the barrel above 24 inches or more, and then they must either step back with the barrel held up or twist their torso around to clear the enclosure. This is not a comfortable range of motion for repetitive tasks. Furthermore, holding the basket with arms extended to perform the loading or unloading is an ergonomically poor method for manually loading and unloading the dryers and back strains and injuries may result.

The produce in the containers used in typical pre-existing vertical produce dryers may be out of balance. At the revolutions per minute that such dryers run, out of balance loads can cause damage to both the dryer and to the produce. Manual readjustment of the load is required, and frequent manual intervention may reduce the quantity of product dried in a given time period.

Vertical dryers typically house the motor and other moving parts under the spinning drum. As a result, in some pre-existing dryer designs, these parts can be difficult to access, and may, in some case, require unbolting the dryer from the floor and placing it up on stands or laying the dryer on it's side.

What is needed is a dryer that can automatically balance it load, that is more ergonomically efficient that prior dryer designs for an operator to load and unload, and that allows easy access to parts of the dryer that are most likely to require service.

SUMMARY OF THE INVENTION

The present invention includes a centrifugal dryer for use with many kinds of objects, but that is particularly suited for use in drying most kinds of produce and vegetables including but not limited to leaf vegetables. While the example embodiments discussed below are configured for use in drying produce, the dryer and method may be easily adapted for drying other items.

In one embodiment, the dryer includes a canted drum design which provides a number of benefits and advantages over prior art designs. The canted design allows the use of a spin drying method that breaks up clumps of material in the dryer and assists in the even distribution of material, thereby improving load balance. The canted design provides ergonomic advantages to the operator when loading and unloading the dryer. And, the canted design allows easy access to the drive system for maintenance and repairs. The invention also includes novel methods of using the dryer of the invention.

In some embodiments, the dryer includes a drum canted at an angle between 30 and 60 degrees from vertical (but preferably at 45 degrees from vertical). A basket or other perforated container holding produce is loaded into the drum and the drum is rotated by a drive assembly. A control system may be used for operating the drive assembly. The control system may include a variable frequency drive and programmable logic control circuits. In some embodiments, the dryer includes a hinged cover, which, in some embodiments, includes a spring assembly to automatically lift the cover when the cover has been manually opened beyond a selected range from a plane in which the cover lies when closed. In some embodiments, the low edge of the top or open end of the drum is between 16 and 30 inches above the floor (and more preferably approximately 18 inches above the floor) to make loading and unloading easy. In some embodiments, the dryer includes a proximity switch capable of sensing whether the cover is open or closed, and in some of these embodiments, the closure of the cover automatically actuates a drying cycle.

A novel method of loading a dryer built in accord with the invention includes the steps:

(a) standing in front of the dryer and grasping the basket so that a center of mass of the basket is near the operator;

(b) lifting the basket and simultaneously swinging a bottom of the basket in an arc clearing a low edge of an open end of the drum; and (c) releasing the basket to allow the basket to slide into the drum.

The method for unloading the dryer is as follows:

(a) grasping the basket;

(b) pulling the basket out by pulling straight toward the chest of the operator;

(c) allowing a bottom of the basket to swing down once the bottom of the basket clears a low edge of the drum; and (d) lowering the basket to a support surface.

The invention also includes a method of drying produce comprising the steps:

(a) providing a drum comprising an axis of rotation, and the axis of rotation being canted at an angle between 30 and 60 degrees from vertical;

(b) loading contents into the drum;

(c) spinning the drum around the axis of rotation at a first revolutions per minute for a selected period of time to roll the contents in order to separate clumps and to allow the contents to distribute evenly, (d) spinning the drum at a second selected revolutions per minute higher than the first revolutions per minute for a second selected period of time cause the contents to improve eveness of distribution of the contents; and (e) spinning the drum at a third selected revolutions per minute higher than the second revolutions per minute for a second selected period of time to cause fluids on the contents to drain away from the contents.

In some embodiments, the method further includes the following steps between steps (d) and (e):

(1) quickly decelerating the drum to break clumps that may have resisted breaking during steps (c) and (d); and (2) repeating steps (c) and (d).

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DETAILED DESCRIPTION

This invention includes a spin or centrifugal dryer and method for efficiently loading, extracting surface water, and unloading objects to be dried. The dryer of the invention is useable for drying many kinds of solid-form objects, but is particularly suited for use in drying produce and vegetables. Thus, while the example embodiments discussed below are configured for use in drying produce, the dryer and method may be easily adapted for drying other items.

In one embodiment, the dryer includes a canted drum design, which provides a number of benefits and advantages over prior art designs. The canted design allows the use of a spin drying method that breaks up clumps of material in the dryer and assists in the even distribution of material, thereby improving load balance. The canted design provides ergonomic advantages to the operator when loading and unloading the dryer. And, the canted design allows easy access to the drive system for maintenance and repairs. The invention also includes novel methods of drying using the canted drum designs built in accord with the invention.

Figure 1:
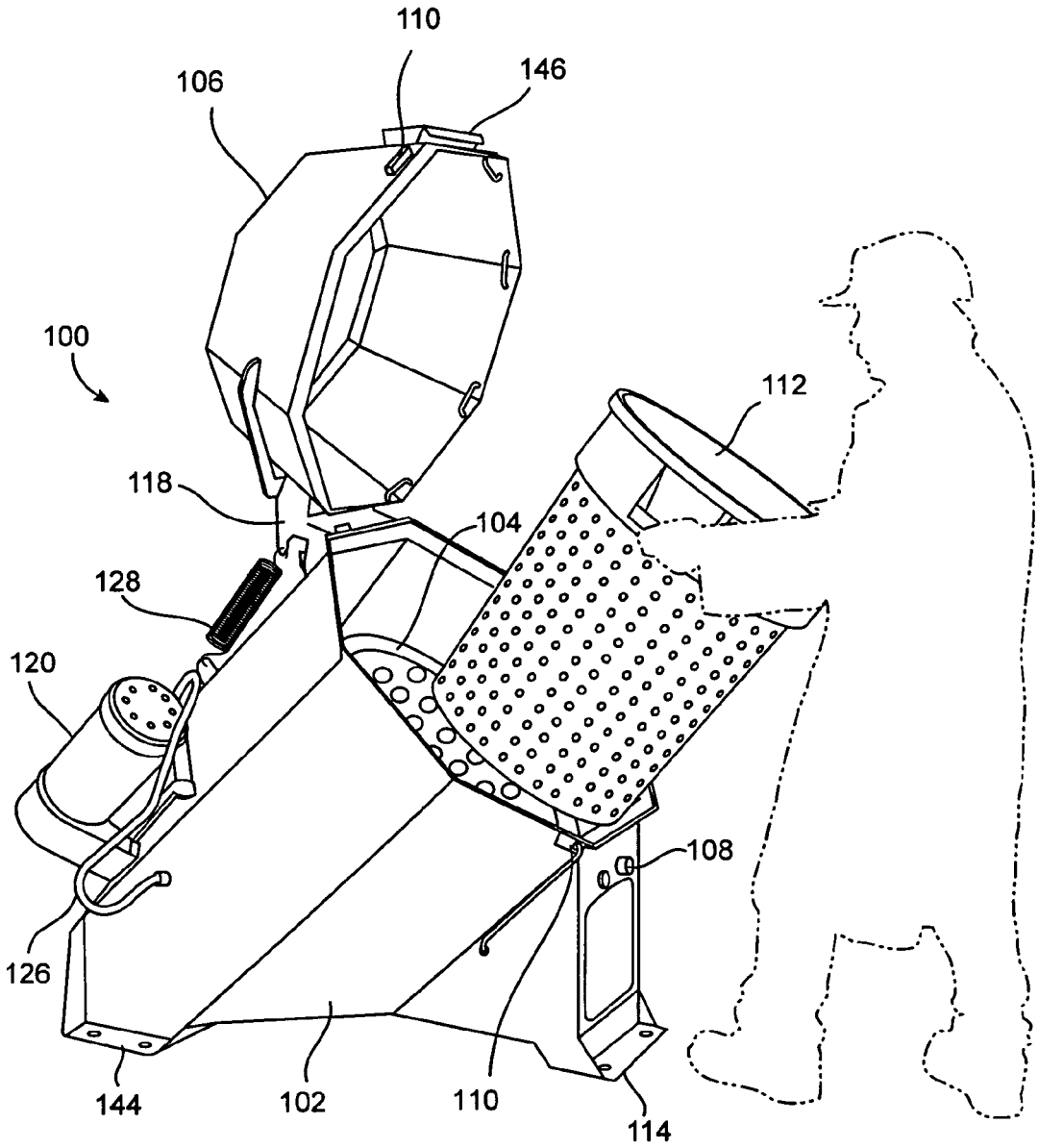
FIG. 1 shows an side view of a dryer, constructed in accord with the invention, being unloaded by an operator.

One example embodiment of the dryer 100 of the invention used for drying produce is seen in FIG. 1. The dryer 100 includes a housing 102 containing a drive assembly 130, and a drum 104 for holding a produce container or basket 112. A cover 106 is hingeably coupled to the housing 102 to allow the dryer 100 to be opened and closed. A control system for controlling the drive assembly 130 (best seen in FIGS. 4 and 5). The control system may also include one or more manual controls such as a start button 108, and one or more sensors or switches such as proximity switch 110. A silhouette representing a person loading or unloading the dryer 100 is shown holding basket 112. The housing 102 includes footings 114 that are coupled to the floor of the facility in which the dryer 100 is used to prevent the dryer 100 from moving during operation. Vibration reducing materials such as rubber spacers may be placed between the dryer 100 footings 114 and the floor.

The drum 104 of the dryer 100 may be canted between 30 and 60 degrees from vertical. However, an angle of approximately 45 degrees has been found to provide a reasonable compromise between the quantity of material that can be dried in each drying cycle, an ergonomically beneficial loading angle, and the ability to roll the contents of the dryer to break up clumps and improve the load balance. The drum 104 and may be constructed of stainless steel or other acceptable food grade material. In the embodiment seen in FIG. 1, the drum 104 is cylindrical, but other shapes may be used in alternate embodiments.

Figure 2:
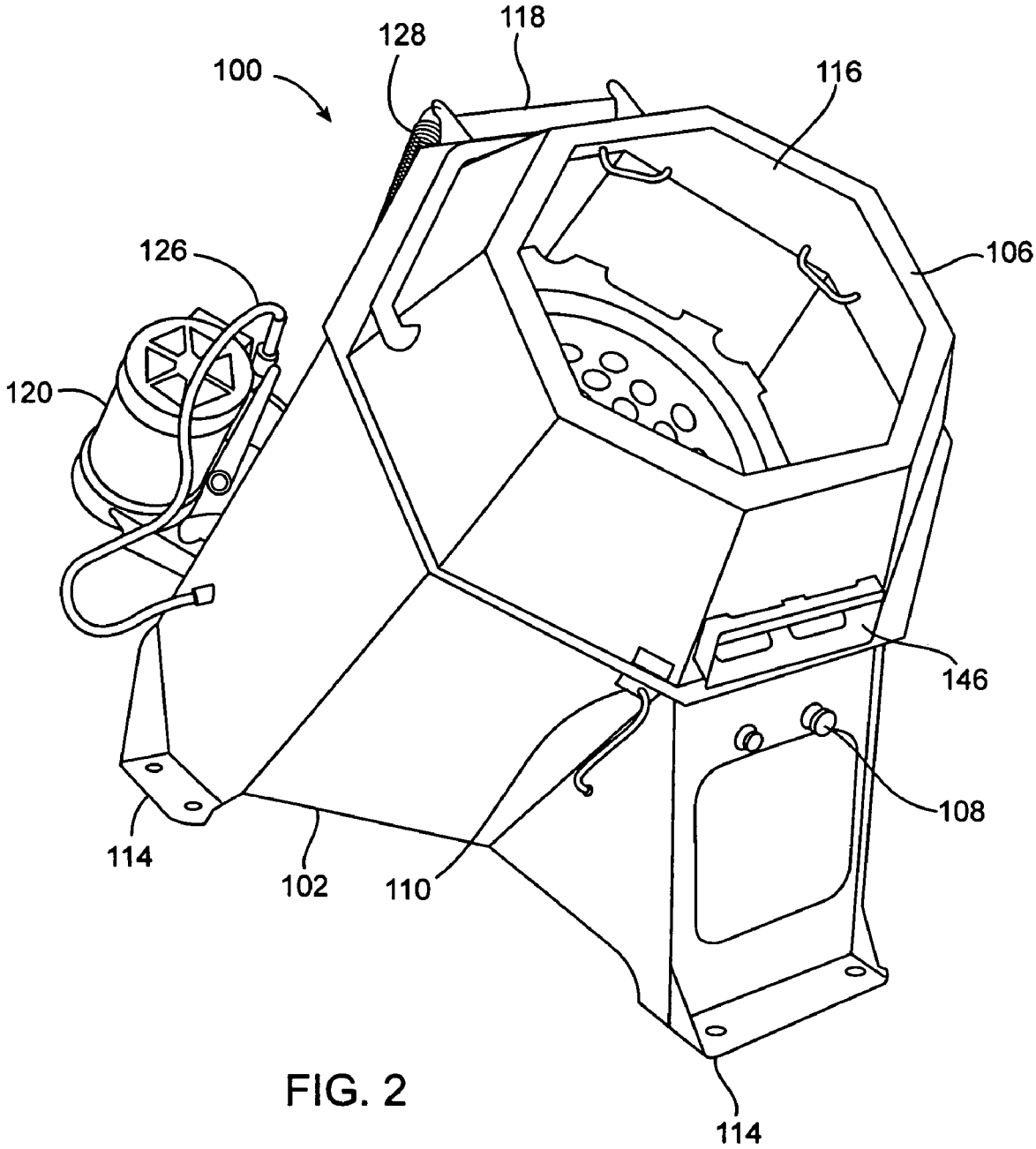
FIG. 2 shows a front perspective view of a dryer with cover closed.

FIG. 2 shows a perspective view of the dryer 100 when the cover 106 is closed. In this embodiment the cover 106 includes a window 116 that allows the operator to monitor the operation of the dryer 100. The window 116 may be formed of an acceptable food grade material including but not limited to known polycarbonate materials. The cover hinge 118 is located at the top of the housing 102 so that the cover 106 is opened by swinging the cover 106 up away from the user. This orientation prevents the cover from interfering with the operator as the operator moves around the dryer 100. The housing 102 and cover 106 may be constructed from a variety of materials, including but not limited to food grade stainless steel alloys. The handle 146 is used to open the cover, and may be constructed from any acceptable material.

The motor 120 is seen mounted on the outside of the housing 102, however, in other embodiments, the motor 120 may be mounted at other locations. A variety of motors are usable in the invention and may be easily selected by one of ordinary skill in the art. The proximity switch 110 is included so that the dryer 100 will not begin to spin while the cover 106 is opened. And, if the cover 106 is opened during the operation of the dryer 100, the proximity switch 100 will open immediately causing the drum 104 to stop. A start button 108 is included on a front lower panel of the dryer 100. In this embodiment, the start button 108 is used only to initiate the first drying cycle. Thereafter the dryer 100 will begin a new cycle each time the cover 106 is closed, until the dryer 100 is turned off. In alternate embodiments, other means for actuating the drying cycle may be used, including manual activation.

The control system, in the embodiment shown, is contained in a space behind the front lower panel 122, but could be positioned elsewhere in other embodiments. The control system including may include a variable frequency drive and programmable logic control circuits for controlling the drive assembly 130, and may also include one or more manual controls such as a start button 108, one or more sensors or switches such as proximity switch 110, and a dynamic break module to improve the speed at which the drum may be decelerated. A communication cable 126 runs between the control system and the drive assembly 130.

Figure 3:
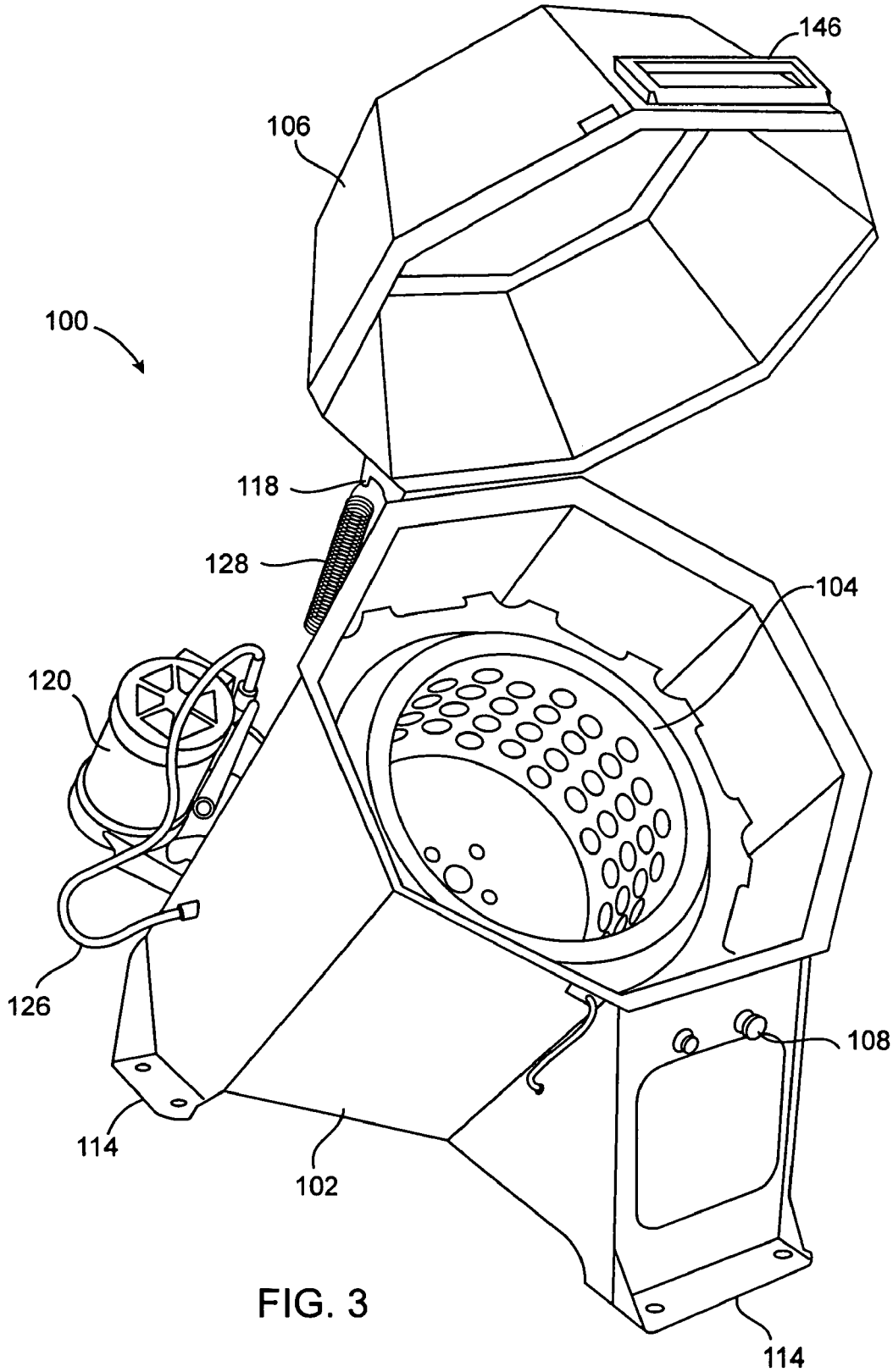
FIG. 3 shows a front perspective view of a dryer with cover open.
Figure 4:
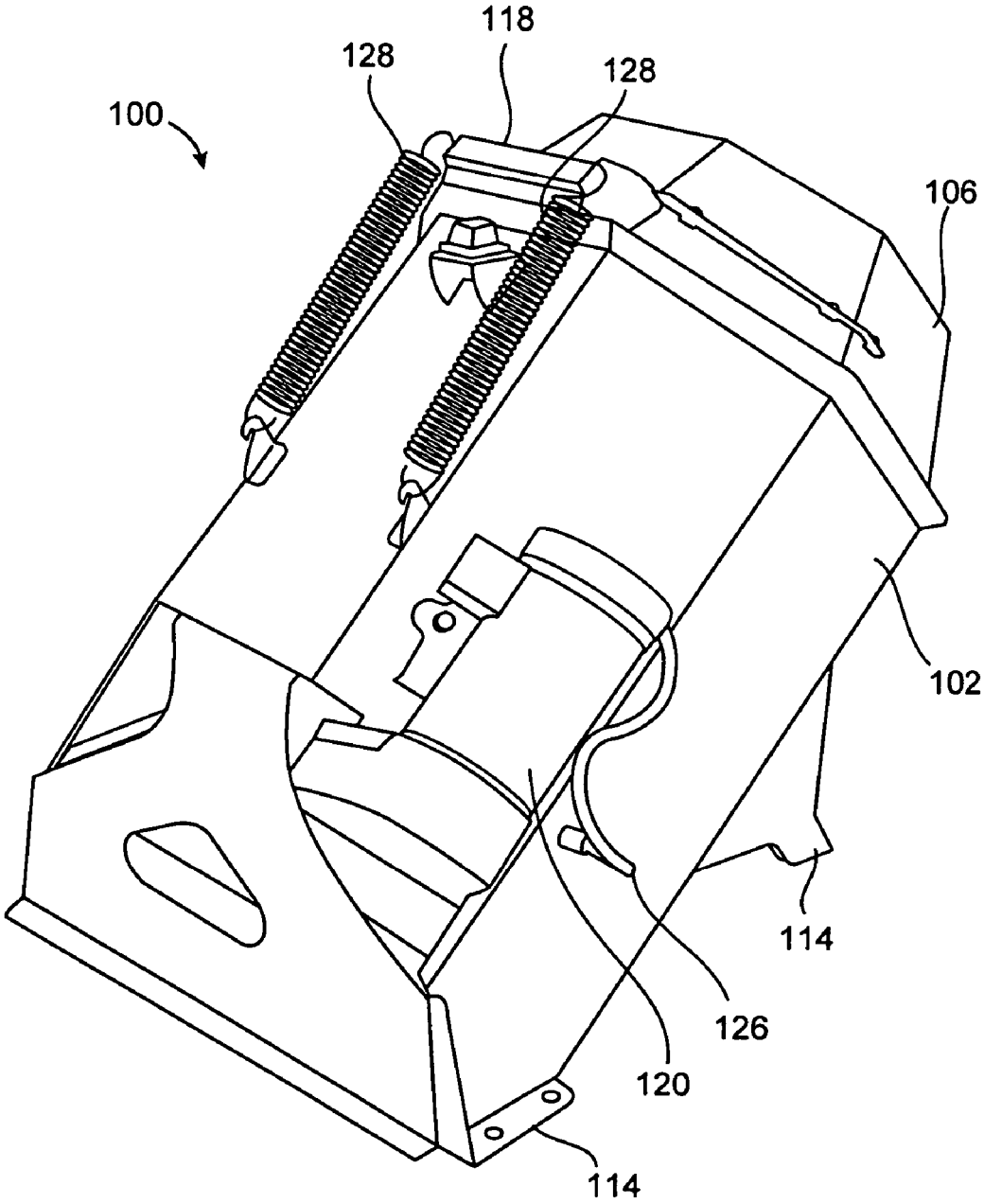
FIG. 4 shows a rear perspective view of a dryer.

A view of the dryer 100 with the cover 106 open is shown in FIG. 3. In this view the drum 104 that accepts the basket 112 is readily seen. The cover 106 is held open by spring force. FIG. 4 shows a rear perspective view of the dryer 100 in which the springs 128 acting on the cover 106 are visible. The springs 128 are coupled at an offset from the hinge 118, and are of a strength selected to automatically lift and hold the cover 106 when an operator has manually lifted the cover 106 beyond a selected angle (preferably between 30 to 60 degrees and more preferably approximately 45 degrees) from the plane in which the cover 106 lies when closed. The springs 128 tend to reduce the perceived weight of the cover 106 to the operator, so that manual operation of the cover 106 is easy and convenient.

In alternate embodiments, automated means for opening and closing the cover 106 may be employed, and such means are well know in the art. For example a hydraulic arm coupled between the housing 102 and the cover 106 could be used to raise and lower the cover 106. However, manual operation has been found to be less expensive and more reliable.

Spin or centrifugal dryers using a drive shaft generally require much of the drive assembly to be positioned below the drum. In many preexisting vertical dryers the entire dryer must be unbolted from the floor and tipped on its side in order to access the drive assembly.

One advantage of the dryer 100 of the invention is seen in FIG. 4, which shows how the drive assembly 130 of the dryer 100 can be easily accessed while the dryer 100 is still in place.

Figure 5:
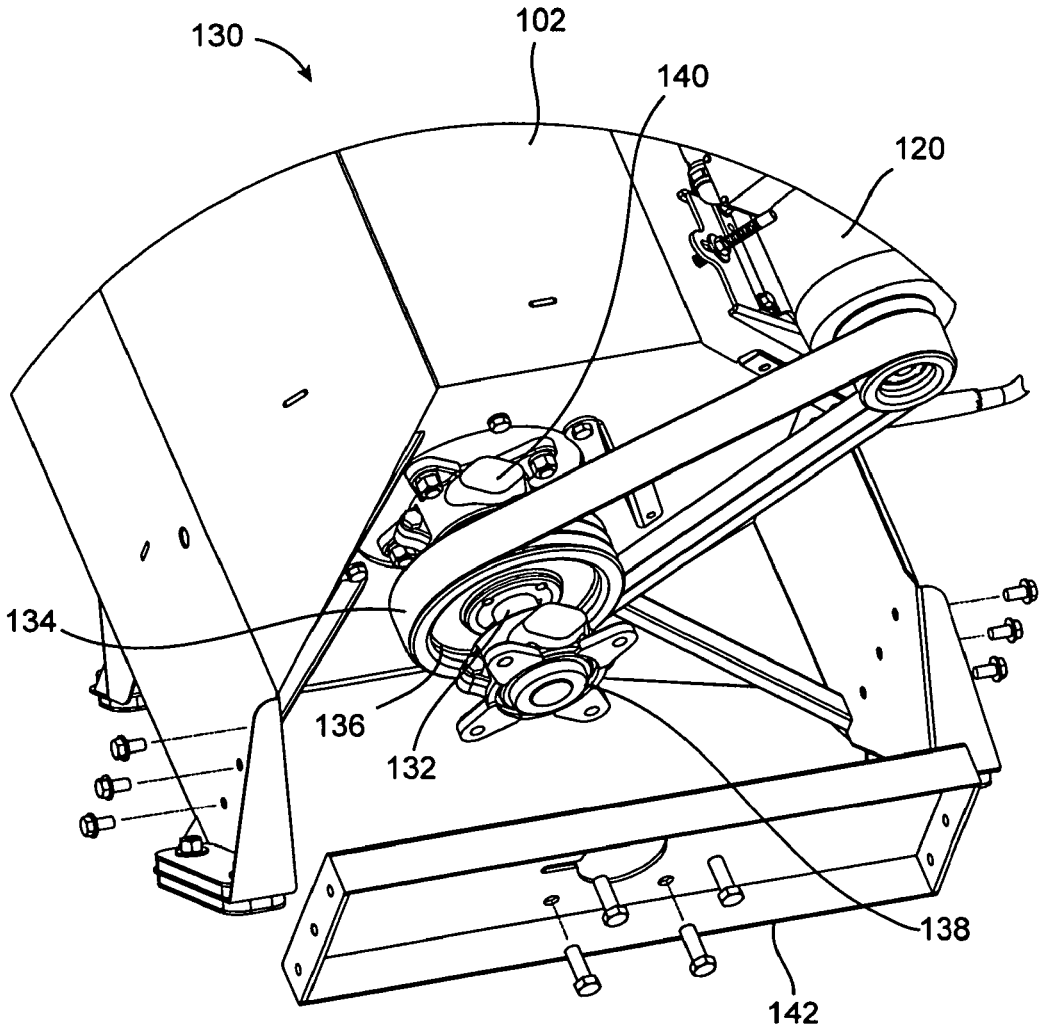
FIG. 5 shows a partially exploded view of a dryer drive system built according to the invention

FIG. 5 shows a view of the housing 102 of the dryer 100 partially disassembled to allow access the drive assembly 130. The motor 120 includes a drive shaft 132 coupled to a belt 134 that is coupled to a drive sheave 136 on a drive shaft 132. In this embodiment the drive shaft 132 is held by a lower bearing 138 coupled to the bearing plate 142 and an upper bearing 140 coupled to an interior wall of the housing 102. The drum 104 inside the housing 102 is coupled to the end of the drive shaft 132. In alternate embodiments, other drive assembly configurations may be used.

Figure 6:
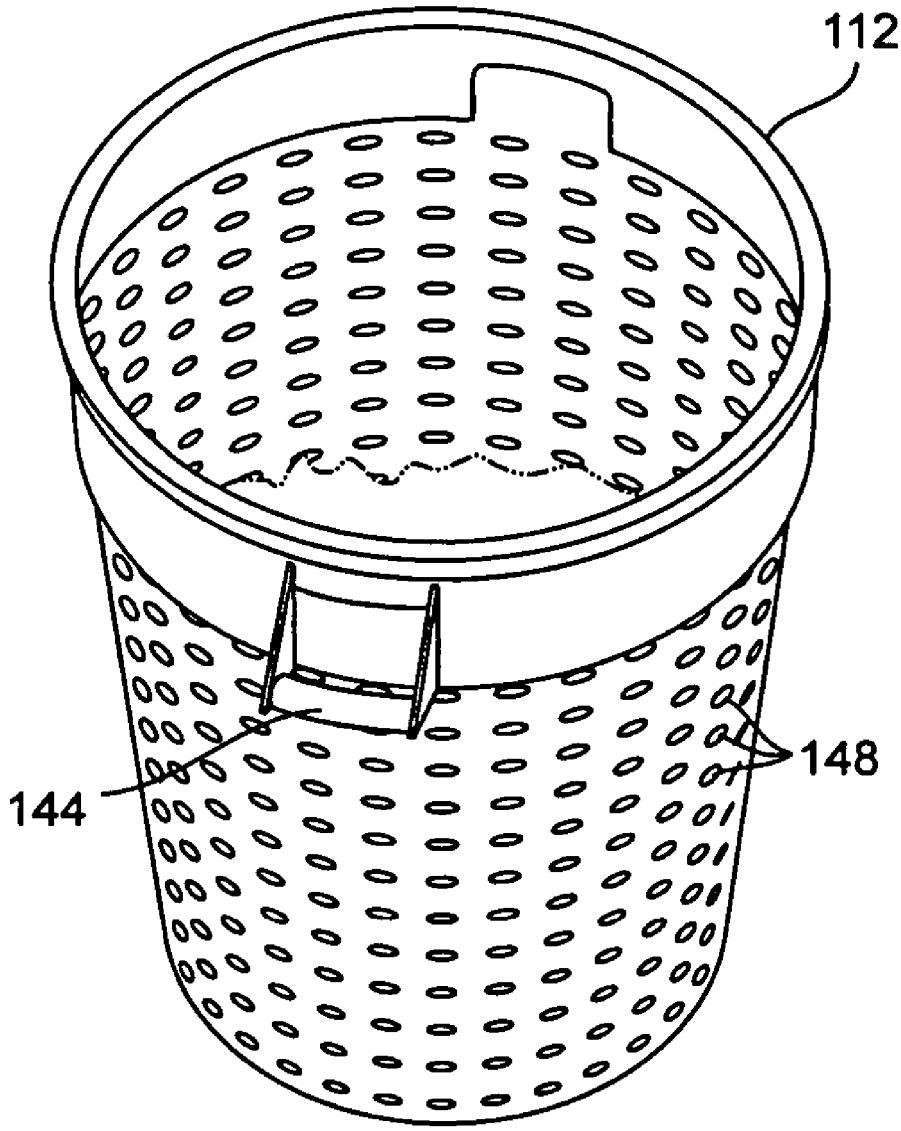
FIG. 6 shows an elevated view of an example basket embodiment useable in the invention.

One embodiment of a basket 112 used in the invention includes a perforated barrel structure including handles 144, as seen in FIG. 6. The apertures 148 are preferably large enough to allow fluid to easily exit the basket, but small enough to contain the produce in the basket. Therefore, the size of apertures 148 may be modified depending on many factors including the kind of item being dried. Desirable characteristics of the basket 112 include construction from a durable food grade material, light weight, handles for manipulating the container, capacity to hold at least 50 pounds of produce, and sufficient height and volume so that the typical produce load in the container will not spill when tipped at 45 degrees from vertical.

Many preexisting vertical dryers require the loaded basket (typically weighing 45 to 70 pounds including wet produce contained within) to be lifted to a height typically of 24 inches or more above the floor, then over the edge of the enclosure or housing around the drum. This typically requires that the operator extend his or her arms, generally at shoulder level, inward over the dryer typically 18 inches or more before the basket is dropped into the dryer. This process is repeated by the operator every couple of minutes as loads are switched, usually on several machines simultaneously. Unloading such pre-existing dryers can be more difficult because the operator must work the basket free with arms extended straight with the center of mass away from the body and curl their arms up to lift the basket usually 24 inches or more, and then they must either step back with the basket held up or twist their torso around to clear the enclosure. This is not a comfortable range of motion for repetitive tasks, and holding the basket with arms extended to perform the loading or unloading as described above has been held responsible for many strains and injuries suffered by the dryer operators.

Unlike the pre-existing dryers described above, the canted design of the present invention provides ergonomic advantages to the operator when loading and unloading the dryer 100. The operator stands in front of the dryer 100 and grasps the basket 112 by handles 144 with arms straight down and the elbows close to the side of the body. The center of mass of the basket 112 is kept close to the operator as the basket 112 is initially lifted, and simultaneously swung in a low arc clearing the low edge of the drum 104 of the canted dryer 100 in one motion with momentum completing the process. The basket 112 is then released to slide into position without further assistance. With a proper stance the operator is not required to exceed his or her comfortable range of motion. Unloading is just as easy with the operator facing the dryer 100, standing at arms length, the handles 144 of the basket 112 are grasped, the arms are extended downward at 45 degrees, then the operator pulls the basket 112 out by pulling straight toward their chest and once the bottom of the basket 112 clears the low edge of the drum 104 and housing 102, the weight of the basket 112 swings it automatically vertical to the ground to be lower to the floor.

Dryers built in accord with the invention are typically used to dry produce that has been washed and rinsed, then loaded into the basket 112. The filled baskets 112 are then delivered to a dryer 100 where the dryer operator will open the cover 106, lift the basket 112 into the drum 104, as described above, and close the cover 106. In some embodiments, when the cover 106 is closed, a dryer cycle is automatically initiated. When the cycle is complete, the operator will remove the basket 112, and place a new basket 112 in its place.

In some embodiments, the canted design of the dryer 100 of the invention allows the use of a spin drying method that breaks up clumps of material in the dryer 100 and assists in the even distribution of material, thereby improving load balance. This is an improvement over pre-existing dryers that accelerate or ramp directly to a drying speed because uneven loads can result, possibly causing damaging to both equipment and product. Also, the method of the invention cannot be performed using vertical dryers.

In general, the method of the invention includes spinning the load at a first revolution per minute selected to roll the contents of the basket 112 in the container in order to separate clumped produce and to allow the individual bits of the contents of the basket 112 to find an angle of repose. The first stage is preferably performed at between 5 and 15 revolutions per minute for 3 to 6 seconds, and more preferably 6 and 10 revolutions per minute for 4 to 5 seconds. The drum 104 is then rotated at a higher speed which is selected to begin to hold the contents against the walls of the basket 112. At this speed, the material near the walls of the basket 112 tend to remain where they are in relation to the basket 112, while contents in the center of the basket 112 can move to even out the distribution of the load. This second stage is preferably run at between 25 and 150 revolutions per minute for 3–6 seconds, and more preferably 30–45 revolutions per minute for 4 to 5 seconds.

In one embodiment of the method, the drum 104 is then accelerated up to drying speed, and is run at that speed for a period of time sufficient to dry the contents of the basket 112. Preferred settings are 500 to 700 revolutions per minute for 3 to 6 minutes, and more preferably 600 to 650 revolutions per minute for 4 to 5 minutes.

In another embodiment of the method, instead of accelerating the drum 104 to drying speed, the drum 104 is quickly decelerated. This causes the produce to shift within the drum 104 and can cause any stubborn clumps that had not previously separated to break up. The deceleration will significantly reduce the revolutions per minute at which the drum is rotating, and in some embodiments may cause to the drum to come to a complete stop. The deceleration process preferably takes 2–3 seconds. Then steps 1 and 2 are repeated once before the drum is accelerated to drying speed.

Those skilled in the art will appreciate that various adaptations and modifications of the just-described preferred embodiments can be configured without departing from the scope and spirit of the invention. For example the rotation speed and time parameters given above may be varied by one skilled in the art depending on various factors including the kind of produce that is being dried, and values outside the ranges given above are considered within the scope of the invention as comprehended by the inventors. Therefore, it is to be understood that, within the scope of the appended claims, the invention may be practiced other than as specifically described herein.

What is claimed is:

1. A manually loaded dryer comprising:

a housing, a drum enclosed in said housing, said drum comprising an axis of rotation, and said axis of rotation being canted at an angle between 30 and 60 degrees from vertical, a basket for holding produce, said basket configured to be received within said drum, a drive assembly for rotating said drum a control system for operating said drive assembly a cover hingeably coupled to said housing, and a spring assembly that automatically lifts said cover when said cover has been manually opened beyond a selected angle between 30 and 60 degrees from a plane in which said cover lies when closed.

2. The manually loaded dryer of claim 1, further comprising a spring assembly that automatically lifts said cover when said cover has been manually opened beyond 45 degrees from a plane in which said cover lies when closed.

3. The manually loaded dryer of claim 1, wherein said basket comprises a perforated drum.

4. The manually loaded dryer of claim 1, wherein said angle of said axis of rotation is canted at approximately 45 degrees from vertical.

5. The manually loaded dryer if claim 1, wherein a lowest point of an open end of said drum is between 16 and 30 inches above a support surface supporting said dryer.

6. The manually loaded dryer of claim 1, wherein a lowest point of an open end of said drum is approximately 18 inches above a support surface supporting said dryer.

7. A manually loaded dryer comprising:

a housing, a drum enclosed in said housing, said drum comprising an axis of rotation, and said axis of rotation being canted at an angle between 30 and 60 degrees from vertical, a basket for holding produce, said basket configured to be received within said drum, a drive assembly for rotating said drum, a control system for operating said drive assembly, a cover hingeably coupled to said housing, and a proximity switch capable of sensing when said cover is open, and when said cover is closed.

8. A manually loaded dryer comprising:

a housing, a drum enclosed in said housing, said drum comprising an axis of rotation, and said axis of rotation being canted at an angle between 30 and 60 degrees from vertical, a basket for holding produce, said basket configured to be received within said drum, a drive assembly for rotating said drum, a control system for operating said drive assembly, a cover hingeably coupled to said housing, and a closure of said cover, automatically actuates a drying cycle.

9. A method of drying produce, said method comprising the steps:

(a) providing a drum comprising an axis of rotation, said axis of rotation being canted at an angle between 30 and 60 degrees from vertical;

(b) loading contents into said drum;

(c) spinning said drum around said axis of rotation at a first revolutions per minute for a selected period of time to roll said contents in order to separate clumps and to allow said contents to distribute evenly;

(d) spinning said drum at a second selected revolutions per minute higher than said first revolutions per minute for a second selected period of time cause said contents to improve eveness of distribution of said contents; and (e) spinning said drum at a third selected revolutions per minute higher than said second revolutions per minute for a second selected period of time to cause fluids on said contents to drain away from said contents.

10. A method of loading the dryer of claim 9, said method comprising the steps:

standing in front of said dryer and grasping said basket so that a center of mass of said basket is near the operator;

lifting said basket and simultaneously swinging a bottom of said basket in an arc clearing a low edge of an open end of said drum; and releasing said basket to allow said basket to slide into said drum.

11. A method of unloading the dryer of claim 9, said method comprising the steps:

grasping said basket;

pulling said basket out by pulling straight toward the chest of the operator;

allowing a bottom of said basket to swing down once said bottom of said basket clears a low edge of said drum; and lowering said basket to a support surface.

12. The method of claim 9, further comprising the following steps between steps (d) and (e):

(1) quickly decelerating said drum to break clumps that may have resisted breaking during steps (c) and (d); and (2) repeating steps (c) and (d).

13. The method of claim 12, wherein said drum is decelerated until stopped, and wherein said deceleration takes between 2–3 seconds.

14. The method of claim 9, wherein said first revolutions per minute is between 5 and 15 revolutions per minute, and said first selected period of time is between 3 and 6 seconds; wherein said second revolutions per minute is between 25 and 150 revolutions per minute, and said second selected period of time is between 3 and 6 seconds; and wherein said third revolutions per minute is between 500 and 700 revolutions per minute, and said third selected period of time is between 3 and 6 minutes.

15. The method of claim 9, wherein said first revolutions per minute is between 6 and 10 revolutions per minute, and said first selected period of time is between 4 and 5 seconds; wherein said second revolutions per minute is between 30 and 45 revolutions per minute, and said second selected period of time is between 4 and 5 seconds; and wherein said third revolutions per minute is between 600 and 650 revolutions per minute, and said third selected period of time is between 4 and 5 minutes.

16. A manually loaded dryer comprising a housing, a drum enclosed in said housing, said drum comprising an axis of rotation, and said axis of rotation being canted at approximately 45 degrees from vertical, a cover hingeably coupled to said housing, said cover comprising a spring assembly that automatically lifts said cover when said cover has been manually opened beyond 45 degrees from a plane in which said cover lies when closed, a basket for holding produce, said basket configured to be received within said drum, said basket comprising a perforated drum, a drive assembly for rotating said drum, a control system for operating said drive assembly, and a proximity switch capable of sensing when said cover is open, and when said cover is closed, said proximity switch in communication with said control system, wherein a closure of said cover, automatically actuates a drying cycle.

* * * * *